US012540517B2

(12) United States Patent
Berge et al.

(10) Patent No.: US 12,540,517 B2
(45) Date of Patent: Feb. 3, 2026

(54) IRON ROUGHNECK WITH ROTARY ACTUATOR

(71) Applicant: Canrig Robotic Technologies AS, Sandnes (NO)

(72) Inventors: Tor Berge, Stavanger (NO); Kjetil Næsgaard, Røyneberg (NO); Roberto Gentile, Stavanger (NO)

(73) Assignee: Canrig Robotic Technologies AS, Sandnes (NO)

( * ) Notice: Subject to any disclaimer, the term of this patent is extended or adjusted under 35 U.S.C. 154(b) by 0 days.

(21) Appl. No.: 18/805,685

(22) Filed: Aug. 15, 2024

(65) Prior Publication Data

US 2025/0059835 A1 Feb. 20, 2025

Related U.S. Application Data

(60) Provisional application No. 63/520,237, filed on Aug. 17, 2023.

(51) Int. Cl.
*E21B 19/16* (2006.01)

(52) U.S. Cl.
CPC ..... *E21B 19/164* (2013.01)

(58) Field of Classification Search
CPC ..... E21B 19/163; E21B 19/165; E21B 19/16; E21B 19/161; E21B 19/167; B25B 13/5025; B25B 13/5041
See application file for complete search history.

(56) References Cited

U.S. PATENT DOCUMENTS 1,806,481 A * 5/1931 Martois ..... E21B 19/16 81/57.24
2,668,689 A * 2/1954 Cormany ..... E21B 19/16 81/57.24
2,760,392 A * 8/1956 Paget ..... E21B 19/163 81/57.24
3,799,009 A * 3/1974 Guier ..... E21B 19/164 81/57.2

(Continued)

FOREIGN PATENT DOCUMENTS

CA 3118648 A1 11/2021
EP 2314827 A2 4/2011

(Continued)

OTHER PUBLICATIONS

International Search Report and Written Opinion for PCT/NO2024/050180, mailed Oct. 10, 2024, 9 pages.

*Primary Examiner* — Kipp C Wallace
(74) *Attorney, Agent, or Firm* — Abel Schillinger, LLP

(57) ABSTRACT

A pipe handler that can include a wrench assembly with a backup tong and a torque wrench, and a rotary actuator coupled to the torque wrench, wherein rotation of the rotary actuator about a second axis rotates the torque wrench about a first axis. An iron roughneck that can include a torque wrench configured to rotate about a first axis, and a rotary actuator coupled to the torque wrench, the rotary actuator having a second axis about which the rotary actuator rotates, where the second axis and the first axis are substantially parallel with each other and spaced apart from each other, and where rotation of the rotary actuator about the second axis rotates the torque wrench about the first axis.

20 Claims, 9 Drawing Sheets

(56) References Cited

U.S. PATENT DOCUMENTS

| | | | | |
|---|---|---|---|---|
| 4,843,945 | A * | 7/1989 | Dinsdale | E21B 19/16 175/85 |
| 5,388,651 | A * | 2/1995 | Berry | E21B 19/16 175/122 |
| 7,188,547 | B1 * | 3/2007 | West | E21B 19/161 81/57.16 |
| 7,191,686 | B1 | 3/2007 | Angelle et al. | |
| 7,313,986 | B2 | 1/2008 | West et al. | |
| 7,665,514 | B2 * | 2/2010 | Patterson | E21B 19/163 166/77.51 |
| 11,560,763 | B2 | 1/2023 | Singla | |
| 11,993,988 | B2 | 5/2024 | Magnuson | |
| 2003/0221871 | A1 * | 12/2003 | Hamilton | E21B 19/14 175/85 |
| 2005/0061112 | A1 * | 3/2005 | Liess | E21B 19/164 81/57.24 |
| 2013/0118315 | A1 * | 5/2013 | Barnett | B25B 17/00 81/57.16 |
| 2017/0211344 | A1 * | 7/2017 | Aalderink | E21B 19/166 |
| 2020/0277826 | A1 | 9/2020 | Mccorriston et al. | |
| 2021/0293101 | A1 | 9/2021 | Søyland | |
| 2024/0287858 | A1 * | 8/2024 | Magnuson | E21B 19/163 |

FOREIGN PATENT DOCUMENTS

| | | | |
|---|---|---|---|
| EP | 2314827 | A3 | 4/2017 |
| WO | 2008034262 | A1 | 3/2008 |

* cited by examiner

IRON ROUGHNECK WITH ROTARY ACTUATOR

CROSS-REFERENCE TO RELATED APPLICATION(S)

This application claims priority under 35 U.S.C. § 119 (e) to U.S. Provisional Application No. 63/520,237, entitled "IRON ROUGHNECK WITH ROTARY ACTUATOR," by Tor BERGE et al., filed Aug. 17, 2023, which is assigned to the current assignee hereof and incorporated herein by reference in its entirety.

FIELD OF THE DISCLOSURE

The present invention relates, in general, to the field of drilling and processing of wells. More particularly, present embodiments relate to a system and method for making up or breaking up tool joint connections in a tubular string during subterranean operations.

BACKGROUND

Iron Roughnecks as well as other tubular manipulators have devices for gripping, holding, spinning, or torquing tubulars during subterranean operations (e.g., drilling, treating, completing, producing, or abandoning a wellbore). These operations may require assembling or disassembling a tubular string that extends into the wellbore from a rig floor. As the tubular string is being extended into the wellbore, successive tubulars are connected to the top end of the tubular string to lengthen it and extend it further into the wellbore. As the tubular string is being disassembled into individual tubulars, the process is reversed with the tubular string being successively pulled from the wellbore an appropriate distance to remove the next tubular by breaking loss a tool joint.

Each connection forms a tool joint, where the tool joint can include a pin end of a tubular threaded into a box end of the tubular string. To prevent failures of the tool joint as the tubular string is being used, there are industry standard torque requirements that should be applied to each tool joint as the tool joint is being made up to ensure proper operation of the tubular string. If these torque requirements are not met, then the tool joint may prematurely separate causing failure of the tool joint and thus failure of the tubular string. Larger diameter tubulars may require up to 120,000 ft-lbs. (162.7 KN-m) of force applied to the tool joint to torque the tool joint to the specified torque requirements. This massive amount of force is applied by torque wrenches in the tubular handling equipment such as iron roughnecks, make-up/break-up tongs, etc. The iron roughnecks are generally used to assemble/disassemble the tubular string at well center which can be considered an "online" operation since its operation directly impacts rig time. The make-up/break-up tongs are generally used "offline" to build tubular stands (e.g., connect two or more tubulars together to form a tubular stand) which can be stored in horizontal or vertical storage areas in preparation for supporting the subterranean operations.

The tubular handling equipment required to deliver up to 120K ft-lbs. (162.7 KN-m) of force tends to be very large and this poses design challenges for equipment, such as iron roughnecks, that may be manipulated by a robotic arm pivotably mounted to a rig floor. Therefore, improvements of tubular handling equipment in support of subterranean operations are continually needed.

SUMMARY

This summary is provided to introduce a selection of concepts that are further described below in the detailed description. This summary is not intended to identify indispensable features of the claimed subject matter, nor is it intended for use as an aid in limiting the scope of the claimed subject matter.

One general aspect includes a pipe handler for a subterranean operation. The pipe handler also includes a wrench assembly may include a backup tong and a torque wrench having a first axis; and a rotary actuator coupled to the torque wrench, where rotation of the rotary actuator about a second axis rotates the torque wrench about the first axis.

One general aspect includes an iron roughneck for applying a torque to a tool joint in a subterranean operation. The iron roughneck also includes a torque wrench configured to rotate about a first axis; and a rotary actuator coupled to the torque wrench, the rotary actuator configured to rotate about a second axis, where the first axis and the second axis are substantially parallel with each other and spaced apart from each other, and where rotation of the rotary actuator about the second axis rotates the torque wrench about the first axis.

One general aspect includes a method for applying a torque to a tool joint in a subterranean operation. The method also includes engaging a tool joint with a first plurality of grippers of a torque wrench; rotating a rotary actuator about a first axis, rotating the torque wrench about a second axis in response to rotation of the rotary actuator, and rotating at least a portion of the tool joint about the second axis in response to the rotation of the torque wrench.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", "generally", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
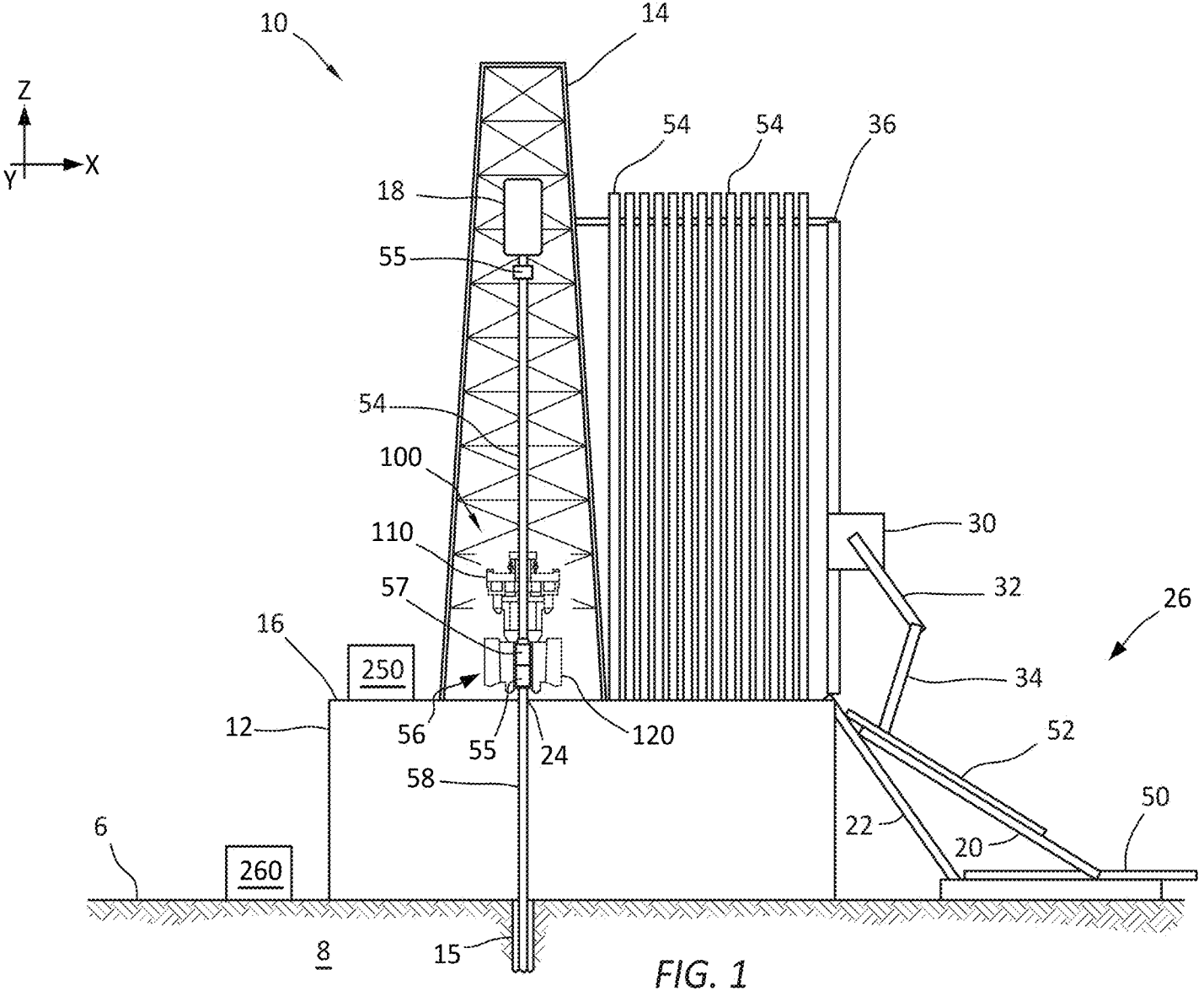
FIG. 1 is a representative simplified front view of a rig being utilized for a subterranean operation, in accordance with certain embodiments.

As used herein, "tubular" refers to an elongated cylindrical tube and can include any of the tubulars manipulated around a rig, such as tubular segments, tubular stands, tubulars, and tubular string, but not limited to the tubulars shown in FIG. 1. Therefore, in this disclosure, "tubular" is synonymous with "tubular segment," "tubular stand," and "tubular string," as well as "pipe," "pipe segment," "pipe stand," "pipe string," "casing string," "coiled tubing", or "wireline."

Figure 5:
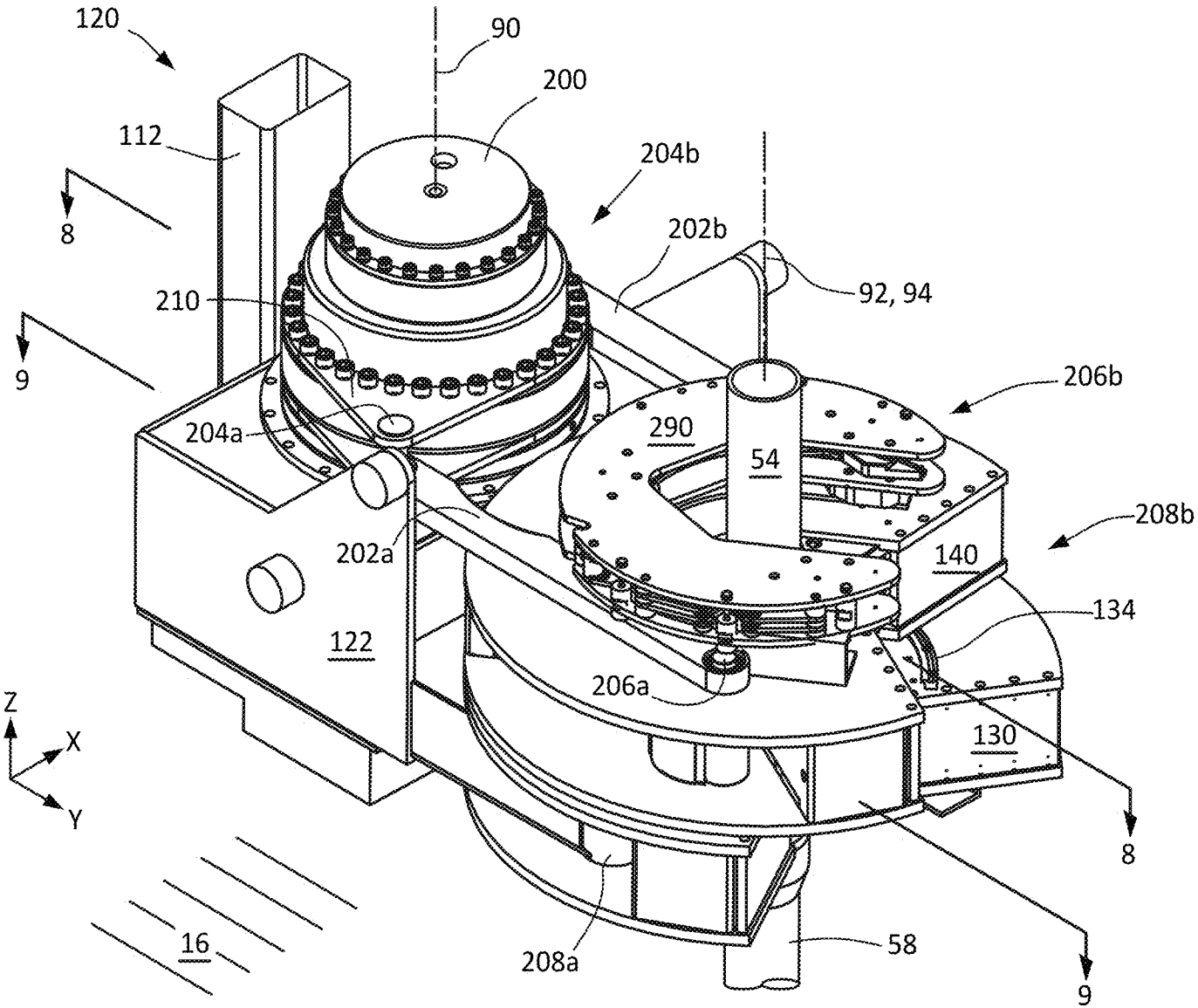
FIG. 5 is a representative perspective view of a wrench assembly of an iron roughneck engaged with a tool joint of a tubular string with the torque wrench rotated to apply torque to the tool joint, in accordance with certain embodiments.

It should be noted that the X-Y-Z coordinate axes are indicated in FIGS. 1 and 5, where the X-Y-Z coordinate axes are relative to the rig floor 16. The rig floor 16 forms an X-Y plane with the Z axis being substantially perpendicular with the rig floor 16. As used herein, "horizontal," "horizontal position," or "horizontal orientation" refers to a position that is substantially parallel with the X-Y plane. As used herein, "vertical," "vertical position," or "vertical orientation" refers to a position that is substantially perpendicular relative to the X-Y plane or substantially parallel with the Z axis.

FIG. 1 is a representative simplified front view of a rig 10 being utilized for a subterranean operation (e.g., tripping in or out a tubular string 58 to or from a wellbore 15), in accordance with certain embodiments. The rig 10 can include a platform 12 with a rig floor 16 and a derrick 14 extending up from the rig floor 16. The derrick 14 can provide support for hoisting the top drive 18 as needed to manipulate tubulars. A catwalk 20 and V-door ramp 22 can be used to transfer horizontally stored tubular segments 50 to the rig floor 16. A tubular segment 52 can be one of the horizontally stored tubular segments 50 that is being transferred to the rig floor 16 via the catwalk 20.

A pipe handler 30 with articulating arms 32, 34 can be used to grab the tubular segment 52 from the catwalk 20 and transfer the tubular segment 52 to the top drive 18, the fingerboard 36, the wellbore 15, etc. However, it is not required that a pipe handler 30 be used on the rig 10. The top drive 8 can transfer tubulars directly between the catwalk 20 and a well center 24 on the rig floor (e.g., using an elevator coupled to the top drive). It is also not required that a catwalk 20 be used to transfer tubulars to/from the horizontal storage area 26. On or more pipe handlers 30 with articulating arms can be used to collect or deliver tubulars between the horizontal storage area 26 and other locations on the rig 10.

As used herein, "tubular" refers to an elongated cylindrical tube and can include any of the tubulars manipulated around the rig 10, such as tubular segments 50, 52, tubular stands, tubulars 54, and tubular string 58, but not limited to the tubulars shown in FIG. 1. Therefore, in this disclosure, "tubular" is synonymous with "tubular segment," "tubular stand," and "tubular string," as well as "pipe," "pipe segment," "pipe stand," "pipe string," "casing," "casing segment," or "casing string."

The tubular string 58 can extend into the wellbore 15, with the wellbore 15 extending through the surface 6 into the subterranean formation 8. When tripping the tubular string 58 into the wellbore 15, tubulars 54 are sequentially added to the tubular string 58 to extend the length of the tubular string 58 into the earthen formation 8. FIG. 1 shows a land-based rig. However, it should be understood that the principles of this disclosure are equally applicable to off-shore rigs where "off-shore" refers to a rig with water between the rig floor and the earth surface 6. When tripping the tubular string 58 out of the wellbore 15, tubulars 54 are sequentially removed from the tubular string 58 to reduce the length of the tubular string 58 in the wellbore 15.

When tripping the tubular string 58 into the wellbore 15, the pipe handler 30 can be used to deliver the tubulars 54 to a well center on the rig floor 16 in a vertical orientation and hand the tubulars 54 off to an iron roughneck 38 or a top drive 18. When tripping the tubular string 58 out of the wellbore 15, the pipe handler 30 can be used to remove the tubulars 54 from the well center in a vertical orientation and receive the tubulars 54 from the iron roughneck 38 or a top drive 18. The iron roughneck 38 can make a threaded connection between a tubular 54 being added and the tubular string 58. A spinner assembly 110 can engage a body of the tubular 54 to spin a pin end 57 of the tubular 54 into a threaded box end 55 of the tubular string 58, thereby threading the tubular 54 into the tubular string 58. The torque wrench 140 can provide a desired torque to the threaded connection, thereby completing the connection. This process can be reversed when the tubulars 54 are being removed from the tubular string 58.

A rig controller 250 can be used to control the rig 10 operations including controlling various rig equipment, such as the pipe handler 30, the top drive 18, the iron roughneck 100, and power systems 260. The rig controller 250 can control the rig equipment autonomously (e.g., without periodic operator interaction,), semi-autonomously (e.g., with limited operator interaction such as initiating a subterranean operation, adjusting parameters during the operation, etc.), or manually (e.g., with the operator interactively controlling the rig equipment via remote control interfaces to perform the subterranean operation). A portion of the rig controller 250 can also be distributed around the rig 10, such as having a portion of the rig controller 250 in the pipe handler 30, in the iron roughneck 100, in the power systems 260, or around the rig 10.

Figure 2:
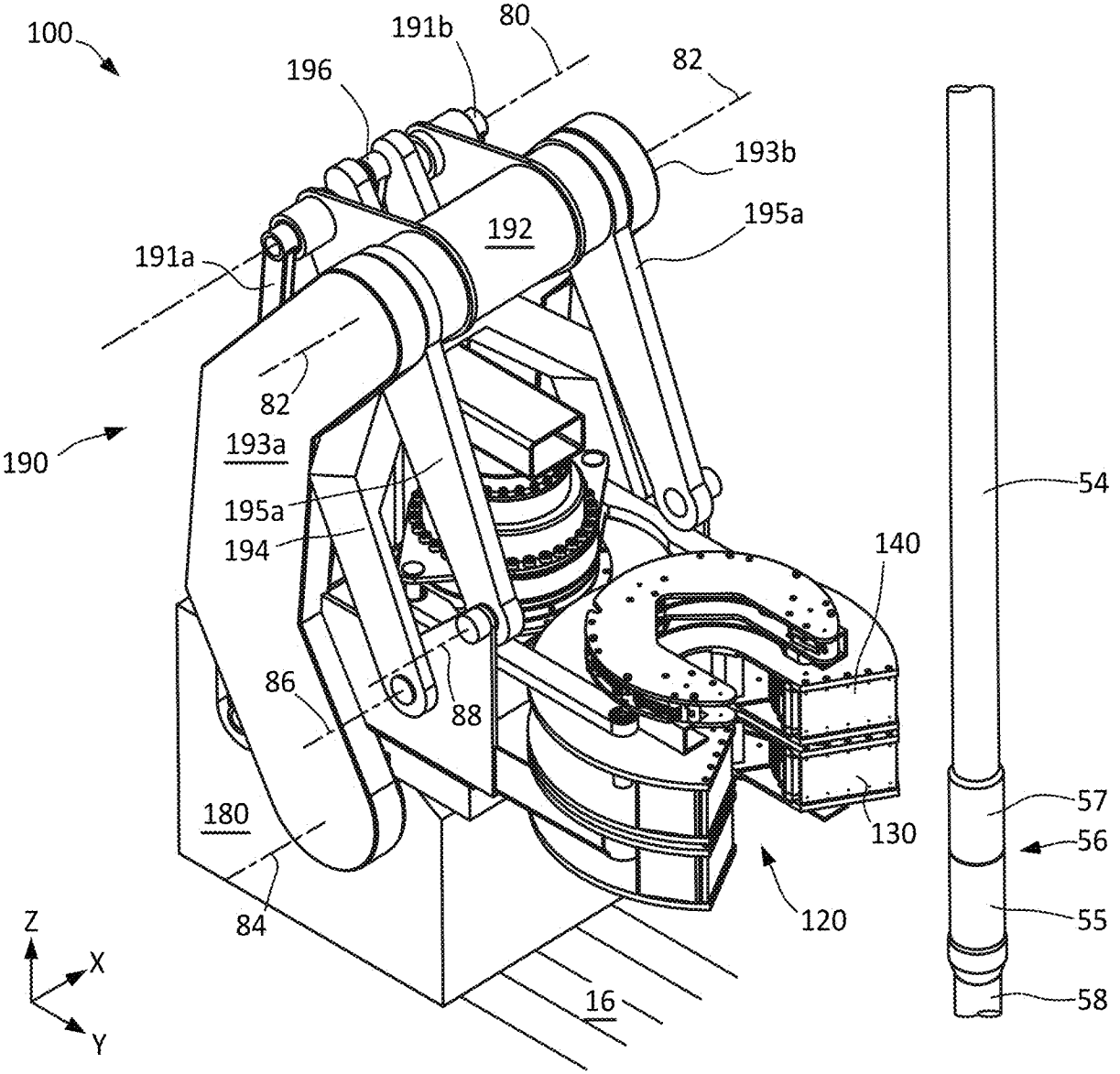
FIG. 2 is a representative perspective view of an iron roughneck in a fully stowed position, in accordance with certain embodiments.
Figure 3:
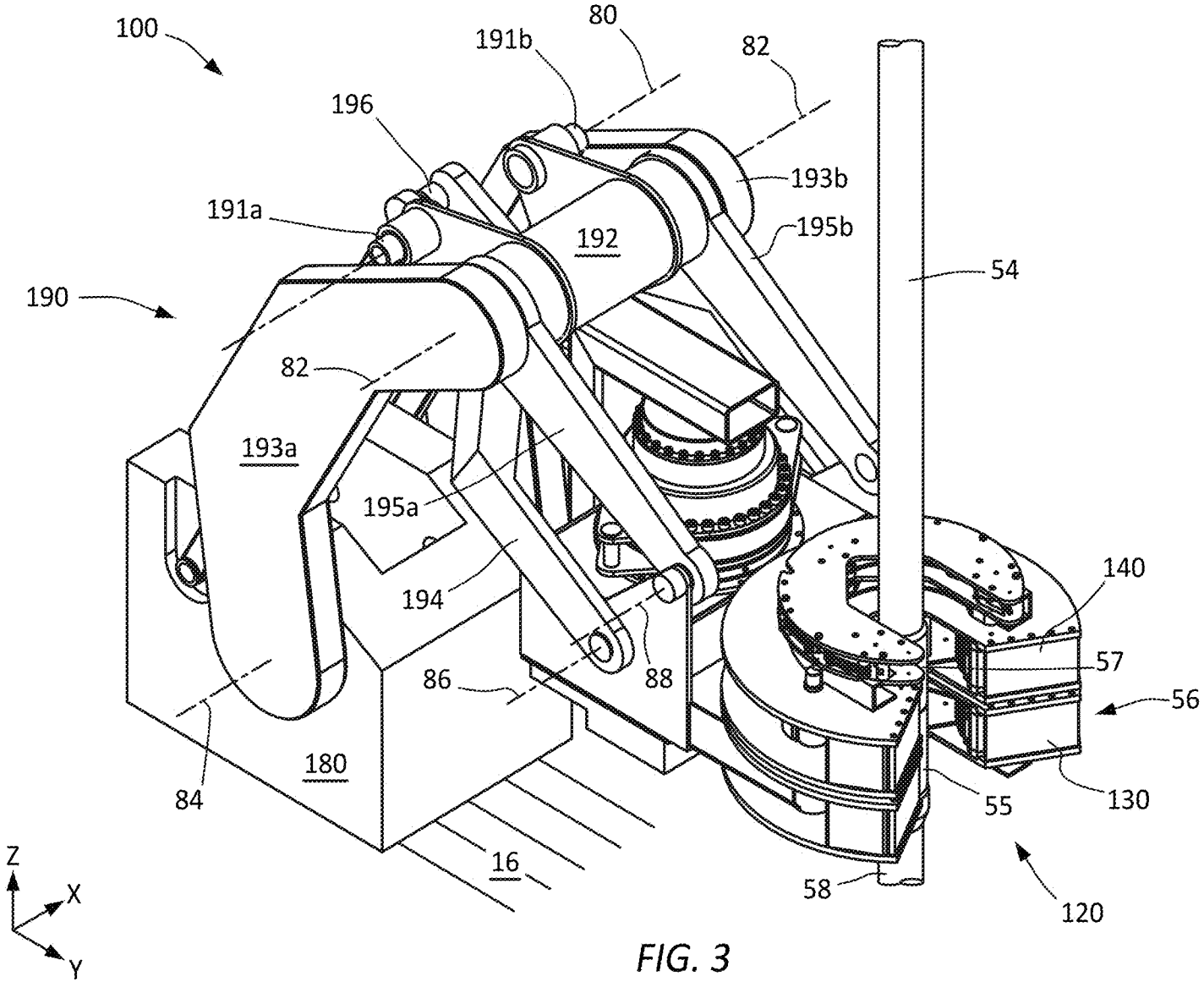
FIG. 3 is a representative perspective view of an iron roughneck in a deployed position to engage a tool joint of a tubular string, in accordance with certain embodiments.

FIG. 2 is a representative perspective view of an iron roughneck 100 in a fully stowed position, in accordance with certain embodiments. In a non-limiting embodiment, the iron roughneck 100 can include a base 180 that is coupled to a wrench assembly 120 by a positioning system 190, which can move the wrench assembly 120 between a fully stowed position (as shown in FIG. 2) and several deployed positions (at least one of which is shown in FIG. 3). Drive arms 193*a*, 193*b* can be rotationally driven about the axis 84 by a motor (not shown) which can be disposed in the base 180. The drive arms 193*a*, 193*b* can be rotationally coupled to the base 180 to pivot about the axis 84 at one end and coupled at an opposite end to opposite ends of a rotational coupling 192.

The rotational coupling 192 can be rotationally coupled to the ends of the drive arms 193*a*, 193*b* to rotate about the axis 82. The rotational coupling 192 can be rotationally coupled to one end of the first links 191*a*, 191*b*, with the opposite ends of the first links 191*a*, 191*b* rotationally coupled to the base 180. The rotational coupling 192 can be rotationally fixed to one end of the third links 195*a*, 195*b*, with the third links 195*a*, 195*b* being rotationally coupled to the wrench assembly 120 on opposite sides of the wrench assembly 120 at the axis 88. A second link 194 can be rotationally coupled at one end to opposite sides of the wrench assembly 120 at the axis 86, with the other end of the second link 194 rotationally coupled to one end of a fourth link 196. An opposite end of the fourth link 196 can be rotationally coupled to the base 180. When the drive arms 193*a*, 193*b* are rotated clockwise about the axis 84, the wrench assembly 120 can be moved away from a stowed position toward a deployed position and held in a horizontal orientation by the positioning system 190. When the drive arms 193*a*, 193*b* are rotated counterclockwise about the axis 84, the wrench assembly 120 can be moved away from a deployed position toward the stowed position and held in the horizontal orientation by the positioning system 190.

FIG. 3 is a representative perspective view of an iron roughneck 100 in a deployed position to engage a tool joint 56 of a tubular string 58, in accordance with certain embodiments. The drive arms 193*a*, 193*b* have been rotated clockwise about the axis 84 and have moved, via the positioning system 190, the wrench assembly 120 from the stowed position to a deployed position with the tool joint 56 positioned within the wrench assembly 120. Openings 139, 149 (see FIGS. 7-9) in the sides of the backup tong 130 and the torque wrench 140 allow access for the tool joint 56 to enter and exit the wrench assembly 120.

Figure 4:
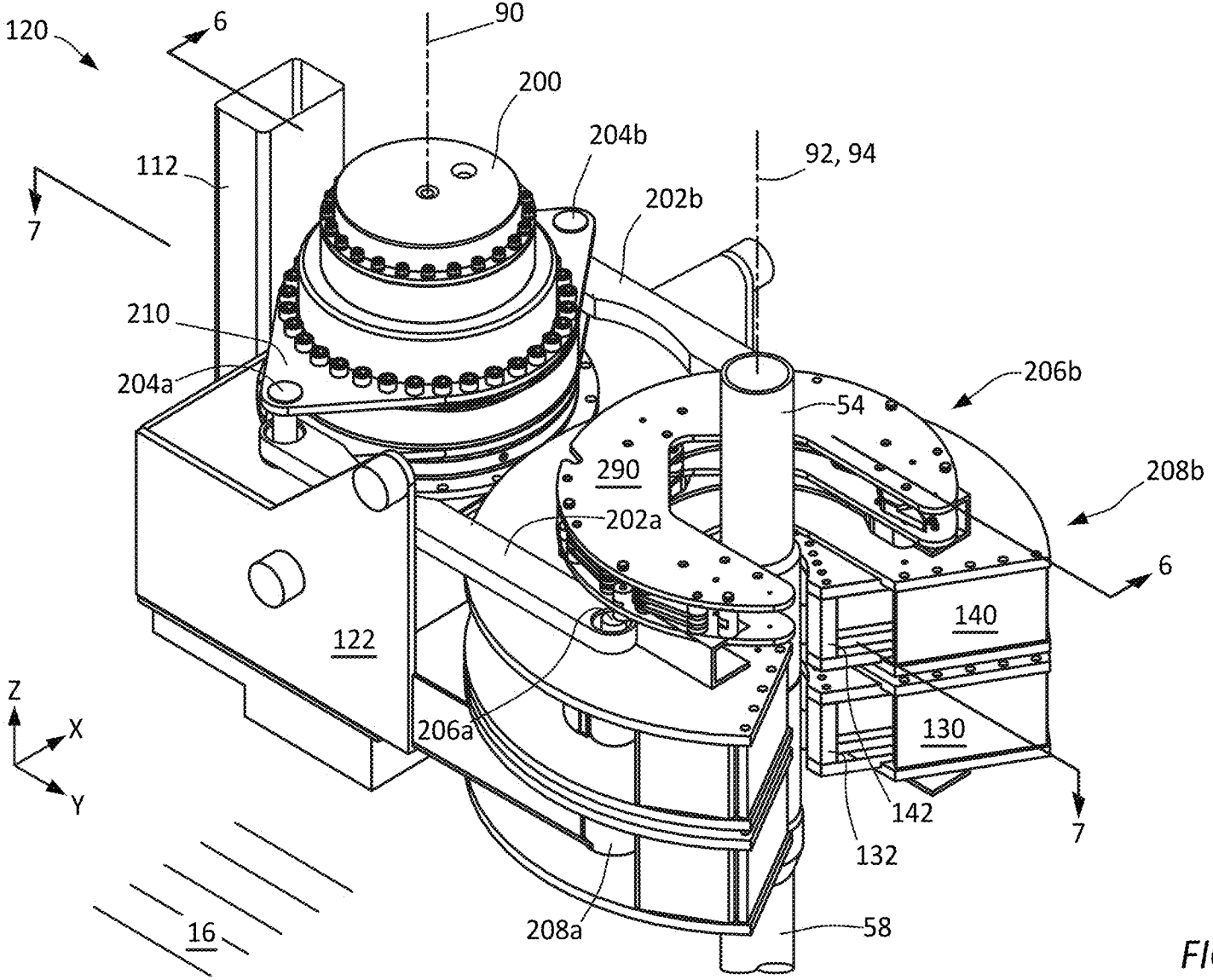
FIG. 4 is a representative perspective view of a wrench assembly of an iron roughneck engaged with a tool joint of a tubular string, in accordance with certain embodiments.

FIG. 4 is a representative perspective view of a wrench assembly 120 of an iron roughneck 100 engaged with a tool joint 56 of a tubular string 58, in accordance with certain embodiments. The wrench assembly 120 can include a backup tong 130 with a plurality of grippers 132, a torque wrench 140 with a plurality of grippers 142, a rotary actuator 200, and a body 122 that provides structural support for the wrench assembly 120 as well as a sealed chamber 124 that houses electrical components. The torque wrench 140 can be rotationally coupled to the backup tong 130 by a circular coupling, with one circular portion 134 (see FIG. 5) fixedly attached to the top of the backup tong 130 and a circular interlocking portion fixedly attached to the bottom of the torque wrench 140 that engages the circular portion 134 that is attached to the backup tong 130.

Figure 6:
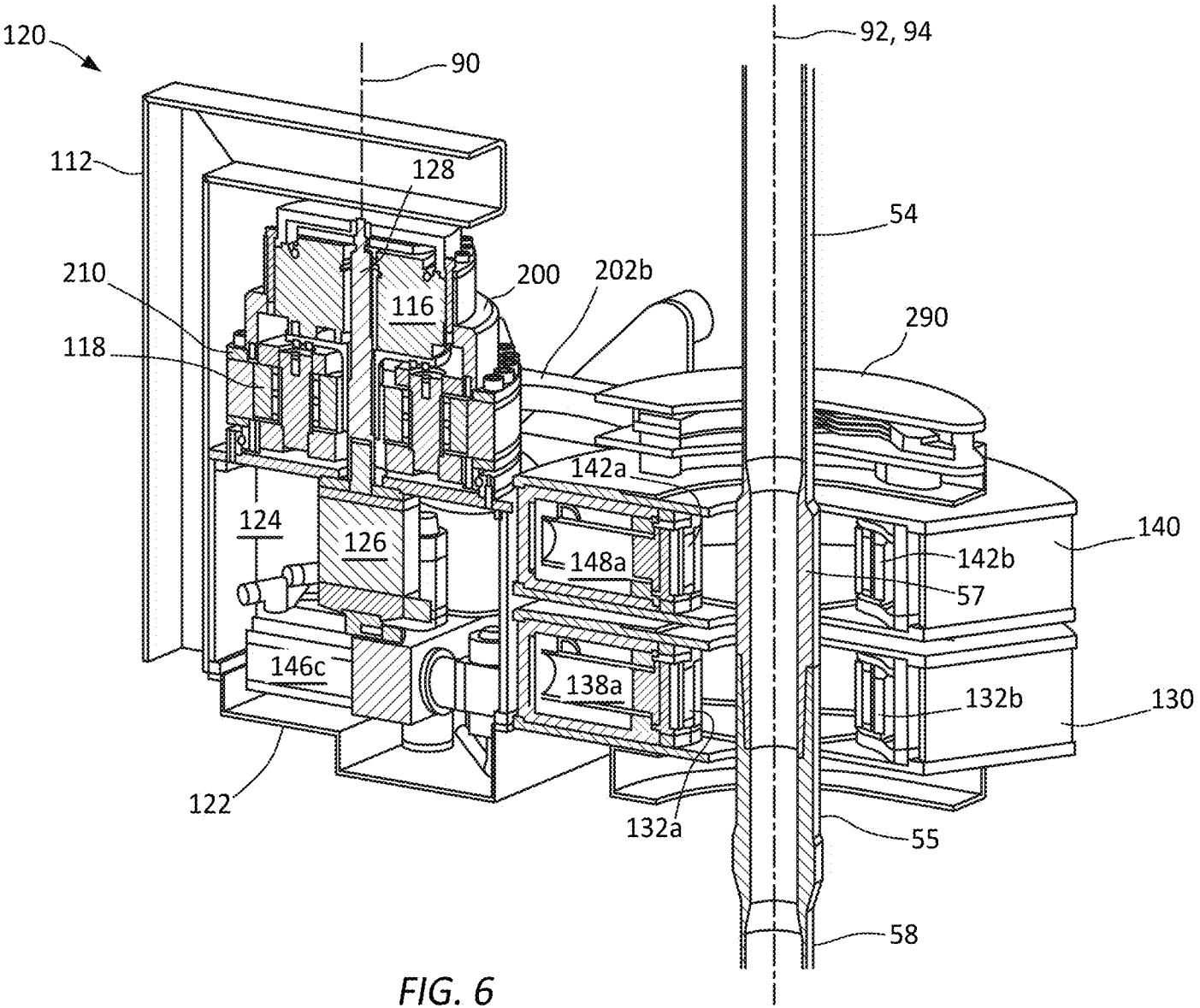
FIG. 6 is a representative partial cross-sectional side view 6-6, as indicated in FIG. 4, of a wrench assembly of an iron roughneck with a tool joint positioned therein, in accordance with certain embodiments.

The rotary actuator 200 can be driven by a motor 126 housed in the chamber 124 (see FIG. 6). The motor 126 can cause the rotary actuator 200 to rotate about the axis 90 as needed to rotate the torque wrench 140 relative to the body 122. A drive plate 210 can be coupled to a drive shaft of the motor 126 to rotate the drive plate 210 relative to the body 122. With pivots 204*a*, 204*b* positioned at opposite ends of the drive plate 210 and with the axis 90 positioned between the pivots 204*a*, 204*b*. The drive plate 210 can be rotated in a horizontal plane to actuate (or rotate) the torque wrench 140. A pair of drive links 202*a*, 202*b* can be rotationally coupled to the drive plate at the pivots 204*a*, 204*b*, respectively, at one end and to the pivots 206*a*, 206*b*, respectively, of the torque wrench 140 at the opposite end.

When the drive plate 210 is rotated in the horizontal plane, the drive links 202*a*, 202*b* are moved in opposite horizontal directions. With the drive link 202*a* being moved in an opposite direction to the link 202*b*, the pivots 206*a*, 206*b* cause the torque wrench 140 to rotate about the axis 94 of the wrench assembly 120 (or the longitudinal axis 92 of the tubular). With the plurality of grippers 142 engaged with a portion of the tool joint 56 (e.g., the pin end 57), the rotation of the torque wrench 140 can rotate the portion of the tool joint 56 (e.g., the pin end 57). If the plurality of grippers 132 of the backup tong 130 are engaged with a lower portion of the tool joint 56 (e.g., the box end 55), then rotation of the upper portion of the tool joint 56 can be rotated relative to the lower portion of the tool joint 56, such as for torquing or untorquing the tool joint 56.

The backup tong 130 can be fixedly coupled to the body 122 at the attachment points 208*a*, 208*b*, which prevents the backup tongs 130 from rotating relative to the body 122. The body 122 can also have a support 112 for supporting the spinner assembly 110 above the torque wrench 140. An alignment device 290 can be mounted to the top of the torque wrench 140 and used to align a tubular 54 to a stickup height of the tubular string 58 when adding tubulars 54 to the tubular string 58.

FIG. 5 is a representative perspective view of a wrench assembly 120 of an iron roughneck 100 engaged with a tool joint 56 of a tubular string 58 with the torque wrench 140 rotated to apply torque to the tool joint 56, in accordance with certain embodiments. The rotary actuator 200 has been rotated about axis 90 from the stowed position shown in FIG. 4 to a rotated position. With the plurality of grippers 142 of the torque wrench 140 and the plurality of grippers 132 of the backup tong 130 engaged with the tool joint 56, then rotation of the torque wrench 140 can rotate, for example, a pin end 57 of the tubular 54 about the axis 94 to torque the pin end 57 to make up or break up the pin end 57 from the box end 55 of the tubular string 58. It should be understood that the rotary actuator 200 can rotate in either direction and the torque wrench 140 will be rotated in the same direction as the rotary actuator 200, due to the links 202*a*, 202*b*. The circular portion 134 is fixedly attached to the top of the backup tong 130 and couples to the circular interlocking portion 135 fixedly attached to the bottom of the torque wrench 140.

FIG. 6 is a representative partial cross-sectional side view 6-6, as indicated in FIG. 4, of a wrench assembly 120 of an iron roughneck 100 with a tool joint 56 positioned therein, in accordance with certain embodiments. The rotary actuator 200 can include a motor 126 contained with a sealed chamber 124 of the body 122. The motor 126 can drive a drive shaft 128, which can drive a gear arrangement of gears 116, 118 to cause the rotary actuator 200 to rotate the drive plate 210. The sealed chamber 124 can contain hydraulic pumps (e.g., 146*c*) that can be used to control actuation of an associated hydraulic actuator (e.g., 148*c*). The hydraulic actuators (e.g., 148*c*) can extend or retract grippers (e.g., 142*c*) to engage or disengage from the tool joint 56. The hydraulic pumps (e.g., 146*c*) can be electrically, pneumatically, or hydraulically driven. By enclosing the pumps in the sealed chamber 124, the pumps can still be operated safely in an explosive environment, such as on a rig floor 16.

Figure 7:
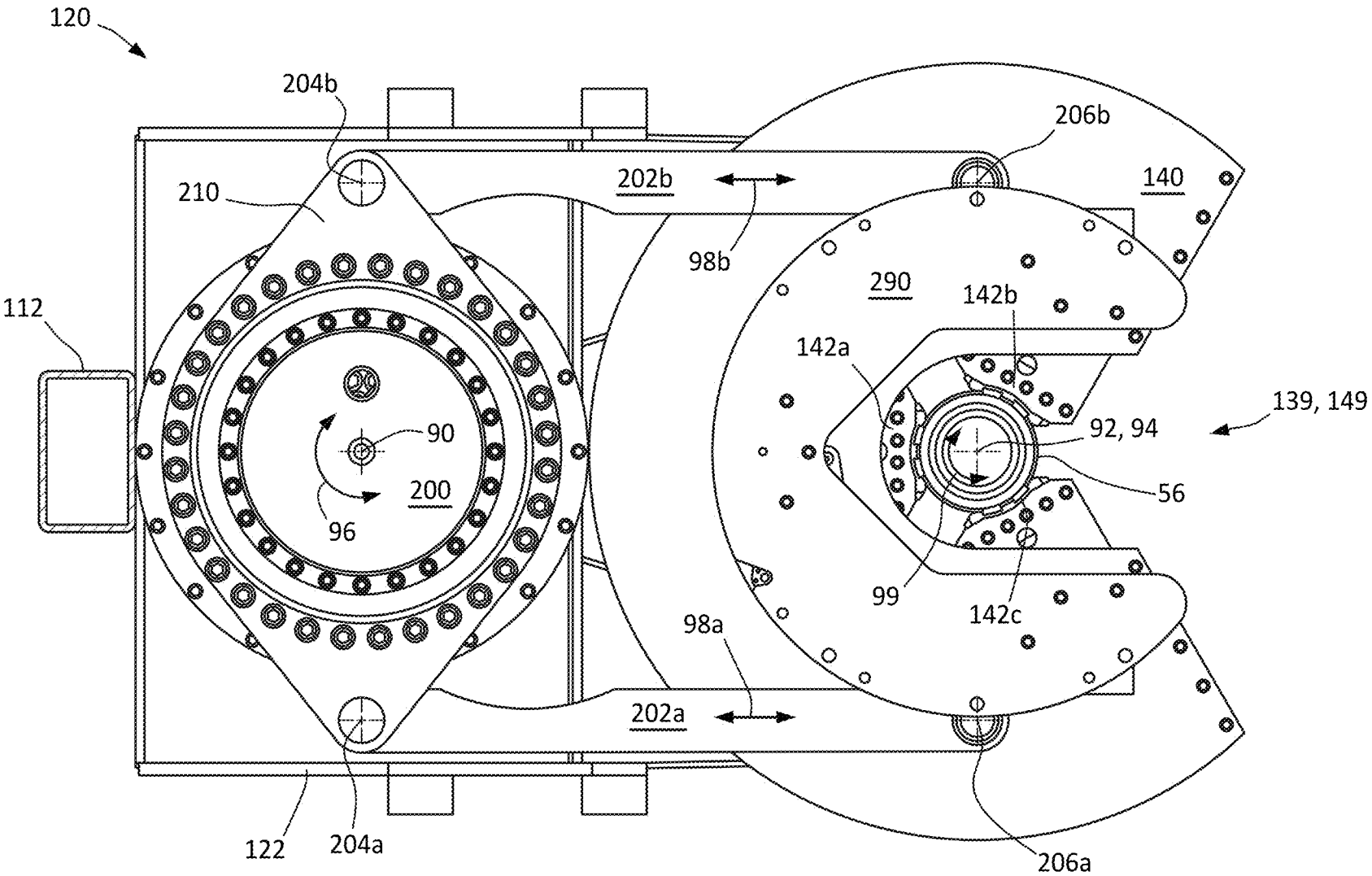
FIG. 7 is a representative partial cross-sectional top view 7-7, as indicated in FIG. 4, of a wrench assembly of an iron roughneck engaged with a tool joint positioned therein, in accordance with certain embodiments.

FIG. 7 is a representative partial cross-sectional top view 7-7, as indicated in FIG. 4, of a wrench assembly 120 of an iron roughneck 100 with a tool joint 56 positioned therein, in accordance with certain embodiments. The torque wrench 140 is rotated to an open configuration where a tool joint 56 can be received through the opening 149 of the torque wrench 140 and the opening 139 of the backup tong 130. The rotary actuator 200 can be rotated in either clockwise or counterclockwise directions (arrows 96) by rotation of the drive shaft 128 of the motor 126. Rotation of the rotary actuator 200 rotates the drive plate 210 in a horizontal plane and moves the links 202*a*, 202*b* horizontally in different directions (arrows 98*a*, 98*b*, respectively) due to the coupling of the links 202*a*, 202*b* to the respective pivots 204*a*, 204*b*.

Movement of the links 202*a*, 202*b* in opposite directions will cause the torque wrench 140 to rotate in a horizontal plane, due to the coupling of the links 202*a*, 202*b* to the torque wrench 140 via the pivots 206*a*, 206*b*. The torque wrench 140 will rotate (arrows 99) about the axis 94 in the same direction as the rotary actuator 200 (arrows 96) about the axis 90. Therefore, if the rotary actuator 200 rotates clockwise (arrows 96), then the torque wrench 140 will rotate clockwise (arrows 99) and if the rotary actuator 200 rotates counterclockwise (arrows 96), then the torque wrench 140 will rotate counterclockwise (arrows 99). If the plurality of grippers 142*a-c* of the torque wrench 140 are extended into engagement with the tool joint 56, then the upper portion of the tool joint 56 (e.g., pin end 57) will be rotated with the torque wrench 140.

Figure 8:
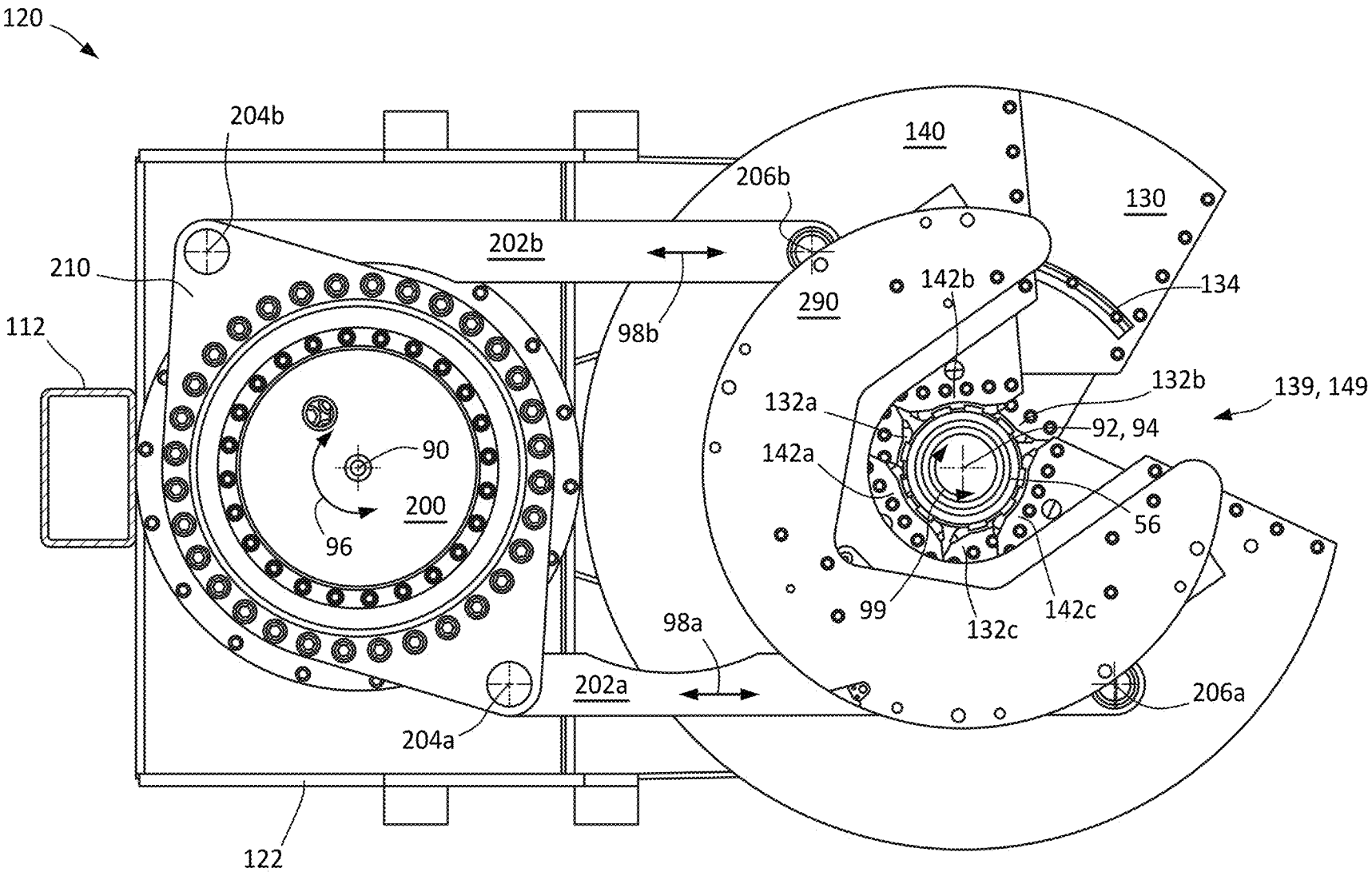
FIG. 8 is a representative partial cross-sectional top view 8-8, as indicated in FIG. 5, of a wrench assembly of an iron roughneck engaged with a tool joint positioned therein and rotated to apply torque to the tool joint, in accordance with certain embodiments.

FIG. 8 is a representative partial cross-sectional top view 8-8, as indicated in FIG. 5, of a wrench assembly 120 of an iron roughneck 100 with a tool joint 56 positioned therein and rotated to apply torque to the tool joint 56, in accordance with certain embodiments. As can be seen, rotation of the rotary actuator 200 in a clockwise direction about the axis 90 will rotate the torque wrench 140 about the axis 94 of the torque wrench 140 and the backup tong 130. The grippers 142*a-c* are shown engaged with the upper portion of the tool joint 56, such that the upper portion of the tool joint 56 has been rotated with the torque wrench 140. The grippers 132*a-c* are shown engaged with the lower portion of the tool joint 56, which prevents the lower portion of the tool joint 56 from rotating with the torque wrench 140 and remains rotationally fixed to the backup tong 130 as long as the grippers 132*a-c* remain engaged with the lower portion of the tool joint 56.

Figure 9:
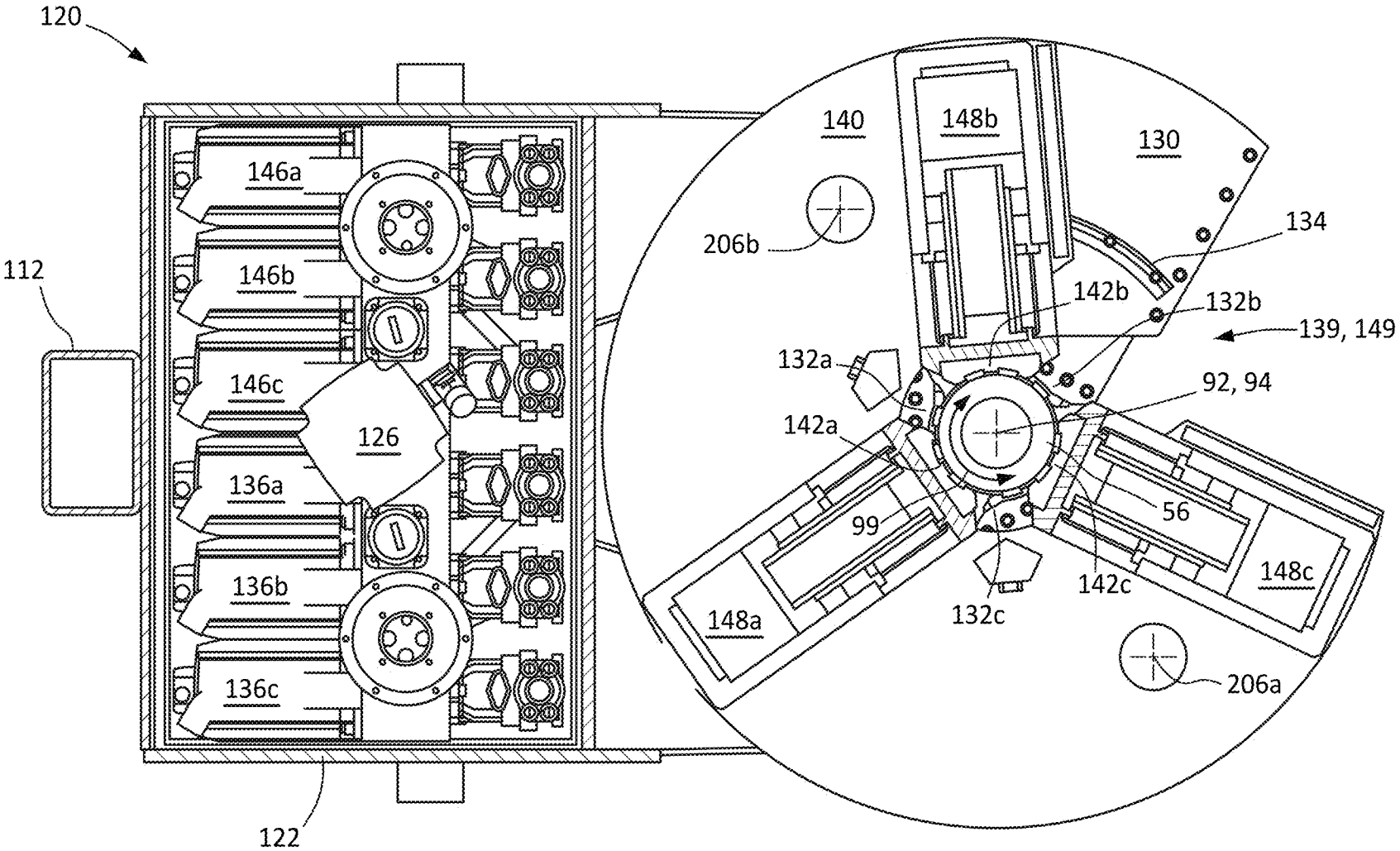
FIG. 9 is a representative partial cross-sectional top view 9-9, as indicated in FIG. 5, of a wrench assembly of an iron roughneck engaged with a tool joint positioned therein showing the hydraulic pumps in a sealed chamber and hydraulic actuators in the torque wrench, in accordance with certain embodiments.

FIG. 9 is a representative partial cross-sectional top view 9-9, as indicated in FIG. 5, of a wrench assembly 120 of an iron roughneck 100 with a tool joint 56 positioned therein showing the hydraulic pumps 146*a-c*, 136*a-c* in a sealed chamber and hydraulic actuators 148*a-c* of the torque wrench 140, in accordance with certain embodiments. The grippers 142*a-c* are shown engaged with the upper portion of the tool joint 56, such that the upper portion of the tool joint 56 has been rotated with the torque wrench 140. The grippers 132*a-c* are shown engaged with the lower portion of the tool joint 56, which prevents the lower portion of the tool joint 56 from rotating with the torque wrench 140 and remains rotationally fixed to the backup tong 130 as long as the grippers 132*a-c* remain engaged with the lower portion of the tool joint 56.

Each of the grippers 142*a-c* and grippers 132*a-c* can have an associated hydraulic actuator (e.g., hydraulic actuators 148*a-c* for respective ones of the grippers 142*a-c*, hydraulic actuators 138*a-c* for respective ones of the grippers 132*a-c*). Each hydraulic actuator can have an associated hydraulic pump disposed in the sealed chamber 124 (e.g., hydraulic pumps 146*a-c* for respective ones of the hydraulic actuators 148*a-c*, hydraulic pumps 136*a-c* for respective ones of the hydraulic actuators 138*a-c*). The sealed chamber 124 can provide a positive internal pressure to provide a purged volume in the sealed chamber 124 to assist in ensuring that no explosive vapors or material enters the chamber 124.

VARIOUS EMBODIMENTS

Embodiment 1. A pipe handler for a subterranean operation, the pipe handler comprising:

a wrench assembly comprising a backup tong and a torque wrench having a first axis; and a rotary actuator coupled to the torque wrench, wherein rotation of the rotary actuator about a second axis rotates the torque wrench about the first axis.

Embodiment 2. The pipe handler of embodiment 1, further comprising:

a base coupled to the wrench assembly, wherein the base is configured to horizontally and vertically position the wrench assembly to engage a tool joint of a tubular string.

Embodiment 3. The pipe handler of embodiment 2, wherein the base is rotationally coupled to a rig floor of a rig.

Embodiment 4. The pipe handler of embodiment 2, wherein the base is movably coupled to a horizontal track on a rig floor of a rig.

Embodiment 5. The pipe handler of embodiment 1, wherein the first axis is substantially parallel with the second axis and spaced apart from the second axis.

Embodiment 6. The pipe handler of embodiment 1, wherein the rotary actuator is coupled to the torque wrench via a first link and a second link.

Embodiment 7. The pipe handler of embodiment 6, wherein the rotary actuator comprises a drive plate that rotates about the second axis, and wherein the first link and the second link are coupled to the drive plate at opposite ends of the drive plate with the second axis being horizontally positioned between the first link and the second link.

Embodiment 8. The pipe handler of embodiment 7, wherein the first link is coupled to the torque wrench on one side of the first axis and the second link is coupled to the torque wrench on an opposite side of the first axis.

Embodiment 9. The pipe handler of embodiment 1, wherein rotation of the rotary actuator in a counterclockwise direction rotates the torque wrench in a counterclockwise direction, and rotation of the rotary actuator in a clockwise direction rotates the torque wrench in a clockwise direction.

Embodiment 10. The pipe handler of embodiment 1, wherein rotation of the torque wrench about the first axis actuates an alignment device that moves a plurality of engagement devices radially inward toward the first axis.

Embodiment 11. An iron roughneck for applying a torque to a tool joint in a subterranean operation, the iron roughneck comprising:

a torque wrench configured to rotate about a first axis; and a rotary actuator coupled to the torque wrench, the rotary actuator having a second axis about which the rotary actuator rotates, wherein the second axis and the first axis are substantially parallel with each other and spaced apart from each other, and wherein rotation of the rotary actuator about the second axis rotates the torque wrench about the first axis.

Embodiment 12. The iron roughneck of embodiment 11, further comprising a backup tong.

Embodiment 13. The iron roughneck of embodiment 12, wherein the backup tong comprises a first plurality of grippers radially positioned around the first axis.

Embodiment 14. The iron roughneck of embodiment 13, wherein the backup tong is configured to engage a first portion of a tool joint of a tubular string when the first plurality of grippers are extended, and wherein engagement of the first plurality of grippers with the first portion prevents rotation of the first portion about the first axis.

Embodiment 15. The iron roughneck of embodiment 14, wherein the torque wrench comprises a second plurality of grippers radially positioned around the first axis.

Embodiment 16. The iron roughneck of embodiment 15, wherein the torque wrench is configured to engage a second portion of the tool joint when the second plurality of grippers are extended, and wherein engagement of the second plurality of grippers with the tool joint prevents rotation of the second portion of the tool joint relative to the torque wrench.

Embodiment 17. The iron roughneck of embodiment 16, wherein rotation of the rotary actuator rotates the torque wrench, and wherein rotation of the torque wrench rotates the second portion of the tool joint when the second plurality of grippers are engaged with the second portion.

Embodiment 18. The iron roughneck of embodiment 12, further comprising a body, wherein the backup tong, the torque wrench, and the rotary actuator are coupled to the body and form a wrench assembly.

Embodiment 19. The iron roughneck of embodiment 18, further comprising a base coupled to a rig floor, wherein the base is coupled to the wrench assembly and is configured to horizontally and vertically position the wrench assembly to engage a tool joint of a tubular string.

Embodiment 20. The iron roughneck of embodiment 19, further comprising a plurality of arms rotationally coupled to the base and rotationally coupled to the wrench assembly, wherein the base and the plurality of arms are configured to horizontally and vertically position the wrench assembly to engage the tool joint of the tubular string.

Embodiment 21. The iron roughneck of embodiment 20, wherein the base is rotationally coupled to the rig floor.

Embodiment 22. The iron roughneck of embodiment 20, wherein the base is movably coupled to a track along the rig floor.

Embodiment 23. The iron roughneck of embodiment 18, wherein the rotary actuator is rotationally coupled to the body, the backup tong is fixedly coupled to the body, and the torque wrench is rotationally coupled to the backup tong.

Embodiment 24. The iron roughneck of embodiment 12, wherein the first axis extends through a first opening in the backup tong and a second opening in the torque wrench wherein the first opening and the second opening are configured to receive a tool joint of a tubular string.

Embodiment 25. The iron roughneck of embodiment 11, further comprising:

a motor that drives the rotary actuator, wherein the motor is disposed in an internal chamber of a body of a wrench assembly of the iron roughneck, wherein the iron roughneck is configured to be safely operated within an explosive environment when the internal chamber is sealed.

Embodiment 26. The iron roughneck of embodiment 25, wherein the motor drives a drive shaft, which is coupled to the rotary actuator, and wherein rotation of the drive shaft rotates the rotary actuator, which rotates the torque wrench about the first axis.

Embodiment 27. The iron roughneck of embodiment 25, wherein the motor comprises an electric motor.

Embodiment 28. The iron roughneck of embodiment 25, further comprising an electrically operated hydraulic pump for each of a first plurality of hydraulic actuators that extend or retract a respective one of a plurality of grippers disposed in a backup tong and the torque wrench.

Embodiment 29. The iron roughneck of embodiment 28, wherein the electrically operated hydraulic pumps are disposed in the internal chamber.

Embodiment 30. The iron roughneck of embodiment 11, wherein rotation of the rotary actuator actuates an alignment device that is configured to urge a tubular toward the first axis and into alignment with a tubular string, when the tubular string is engaged with a backup tong.

Embodiment 31. A method for applying a torque to a tool joint in a subterranean operation, the method comprising:

engaging a tool joint with a first plurality of grippers of a torque wrench;

rotating a rotary actuator about a first axis;

rotating the torque wrench about a second axis in response to rotation of the rotary actuator; and rotating at least a portion of the tool joint about the second axis in response to the rotation of the torque wrench.

Embodiment 32. The method of embodiment 31, wherein the first axis is parallel with and spaced apart from the second axis.

Embodiment 33. The method of embodiment 31, further comprising:

rotating a drive shaft of a motor; and rotating the rotary actuator in response to rotation of the drive shaft.

Embodiment 34. The method of embodiment 33, wherein rotating the rotary actuator rotates a drive plate, and wherein the drive plate is coupled to the torque wrench by a first link and a second link.

Embodiment 35. The method of embodiment 34, wherein the drive plate comprises a first drive pivot at one end of the drive plate, a second drive pivot at an opposite end of the drive plate, and the first axis being positioned between the first drive pivot and the second drive pivot.

Embodiment 36. The method of embodiment 35, wherein the first link is rotationally coupled at one end to the drive plate by the first drive pivot and rotationally coupled at an opposite end to the torque wrench by a first torque pivot, the second link is rotationally coupled at one end to the drive plate by the second drive pivot and rotationally coupled at an opposite end to the torque wrench by a second torque pivot, and wherein the first torque pivot is positioned on the torque wrench on an opposite side of the second axis.

Embodiment 37. The method of embodiment 36, wherein rotating the rotary actuator moves the first link horizontally in one direction and moves the second link horizontally in an opposite direction.

Embodiment 38. The method of embodiment 31, wherein a first link is rotationally coupled to the rotary actuator at one end and rotationally coupled to the torque wrench at an opposite end and a second link is rotationally coupled to the rotary actuator at one end and rotationally coupled to the torque wrench at an opposite end, and wherein rotating the rotary actuator moves the first link horizontally in one direction and moves the second link horizontally in an opposite direction, thereby rotating the torque wrench in response to horizontal movements of the first link and the second link.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A pipe handler for a subterranean operation, the pipe handler comprising:

a wrench assembly comprising a backup tong and a torque wrench having a first axis;

a rotary actuator having a drive plate that rotates about a second axis; and a first drive link rotationally coupled at one end to the drive plate at a first pivot that is spaced radially outward he second axis and rotationally coupled at an opposite end to the torque wrench at a second pivot that is spaced radially outward from the first axis, wherein rotation of the drive plate about the second axis drives the first drive link which rotates the torque wrench about the first axis.

2. The pipe handler of claim 1, further comprising:

a base coupled to the wrench assembly, wherein the base is configured to horizontally and vertically position the wrench assembly to engage a tool joint of a tubular string.

3. The pipe handler of claim 1, wherein the first axis is substantially parallel with the second axis and spaced apart from the second axis.

4. The pipe handler of claim 1, further comprising a second drive link rotationally coupled at one end to the drive plate at a third pivot that is spaced radially outward from the second axis and radially away from the first pivot, and rotationally coupled at an opposite end to the torque wrench at a fourth pivot that is spaced radially outward from the first axis and radially away from the second pivot.

5. The pipe handler of claim 4, wherein rotation of the drive about the second axis drives the first drive link and the second drive link in opposite directions and rotates the torque wrench about the first axis.

6. An iron roughneck for applying a torque to a tool joint in a subterranean operation, the iron roughneck comprising:

a torque wrench configured to rotate about a first axis; and a rotary actuator coupled to the torque wrench, the rotary actuator comprising a drive plate configured to rotate about a second axis, a first drive link and a second drive link that are rotationally coupled to opposite sides, relative to the second axis, of the drive plate, wherein the first drive link and the second drive link are rotationally coupled opposite sides, relative to the first axis, of the torque wrench, wherein the first axis and the second axis are substantially parallel with each other and spaced apart from each other, and wherein rotation of the drive plate about the second axis drives the first drive link and the second drive link in opposite directions, and rotates the torque wrench about the first axis.

7. The iron roughneck of claim 6, wherein the torque wrench comprises a first plurality of grippers positioned circumferentially around the first axis.

8. The iron roughneck of claim 7, wherein the torque wrench is configured to engage a first portion of a tool joint of a tubular string when the first plurality of grippers are extended, and wherein engagement of the first plurality of grippers with the first portion prevents rotation of the first portion of the tool joint relative to the torque wrench.

9. The iron roughneck of claim 8, wherein rotation of the rotary actuator rotates the torque wrench, and wherein rotation of the torque wrench rotates the first portion of the tool joint when the first plurality of grippers are engaged with the first portion.

10. The iron roughneck of claim 9, further comprising a backup tong, wherein the backup tong comprises a second plurality of grippers positioned circumferentially around the first axis.

11. The iron roughneck of claim 10, wherein the backup tong is configured to engage a second portion of the tool joint when the second plurality of grippers are extended, and wherein engagement of the second plurality of grippers with the tool joint prevents rotation of the second portion of the tool joint about the first axis.

12. The iron roughneck of claim 6, further comprising:

a motor that drives the rotary actuator, wherein the motor is disposed in an internal chamber of a body of a wrench assembly of the iron roughneck, wherein the iron roughneck is configured to be safely operated within an explosive environment when the internal chamber is sealed.

13. The iron roughneck of claim 12, wherein the motor drives a drive shaft, which is coupled to the rotary actuator, and wherein rotation of the drive shaft rotates the rotary actuator, which rotates the torque wrench about the first axis.

14. The iron roughneck of claim 13, further comprising an electrically operated hydraulic pump for each of a first plurality of hydraulic actuators that extend or retract a respective one of a plurality of grippers disposed in a backup tong and the torque wrench, wherein the electrically operated hydraulic pumps are disposed in the internal chamber.

15. A method for applying a torque to a tool joint in a subterranean operation, the method comprising:

engaging a tool joint with a first plurality of grippers of a torque wrench with a first axis;

rotationally coupling a first drive link to a first pivot a drive plate of a rotary actuator, wherein the first pivot is spaced radially outward from a second axis:

rotationally coupling the drive link to a second pivot on the torque wrench wherein the second pivot is spaced radially outward from the first axis:

rotating the drive plate about the second axis thereby driving the first drive link in a first direction;

rotating the torque wrench about the first axis in response to driving the first drive link in the first direction; and rotating at least a portion of the tool joint about the first axis in response to the rotation of the torque wrench.

16. The method of claim 15, wherein the first axis is generally parallel with and spaced apart from the second axis.

17. The method of claim 15, further comprising:

rotating a drive shaft of a motor; and rotating the drive plate in response to rotation of the drive shaft.

18. The method of claim 17, further comprising:

rotationally coupling a second drive link to a third pivot on the drive plate, wherein the third pivot is spaced radially outward from the second axis and disposed opposite the first pivot, and rotationally coupling the second drive link to a fourth pivot on the torque wrench, wherein the fourth pivot is spaced radially outward from the first axis and disposed opposite the second pivot.

19. The method of claim 18, wherein rotating the drive plate moves the first drive link horizontally in one direction and moves the second drive link horizontally in an opposite direction.

20. The method of claim 18, wherein the first drive link is parallel with the second drive link and remains parallel with the second drive link while the drive plate is rotated.

* * * * *